United States Patent [19]

Saurwein

[11] 4,096,649

[45] Jun. 27, 1978

[54] ATHLETIC SHOE SOLE

[76] Inventor: Albert C. Saurwein, 19702 - 37th Pl. S., Seattle, Wash. 98188

[21] Appl. No.: 747,353

[22] Filed: Dec. 3, 1976

[51] Int. Cl.[2] ..... A43B 13/04

[52] U.S. Cl. ..... 36/32 R; 36/59 C

[58] Field of Search ..... 36/32 R, 59 R, 59 C, 36/128; 172/320

[56] References Cited

U.S. PATENT DOCUMENTS

| | | | |
|---|---|---|---|
| D. 201,952 | 8/1952 | Johns | 36/59 C X |
| 436,553 | 9/1890 | Wilson | 36/59 C |
| 1,552,022 | 9/1925 | Willson | 36/59 C |
| 1,653,059 | 12/1927 | Nelson | 36/59 C X |
| 1,962,526 | 6/1934 | Riddell | 36/59 R |
| 2,279,891 | 4/1942 | Maselter | 36/59 C |
| 3,114,981 | 12/1963 | Murawski | 36/32 R X |

FOREIGN PATENT DOCUMENTS

| | | | |
|---|---|---|---|
| 473,286 | 10/1937 | United Kingdom | 36/59 C |

*Primary Examiner*—Alfred R. Guest

*Attorney, Agent, or Firm*—Christensen, O'Connor, Johnson & Kindness

[57] ABSTRACT

An athletic shoe sole has a heel section and a toe section bearing flange-shaped, turf-gripping members. The first gripping member is a generally downwardly and outwardly extending flange that runs around the entire periphery of the sole. The second gripping member is an ovoid-shaped, generally downwardly and outwardly extending toe flange positioned in the toe section of the sole and spaced inwardly from the portion of the peripheral flange on the toe section. The third gripping member is a heel flange extending downwardly and outwardly from the heel section of the shoe and spaced inwardly from the portion of the peripheral flange on the heel section. The rearward portion of the heel flange is arcuate and merges into two generally forwardly extending flange portions that flare outwardly and join with the peripheral flange adjacent the forward end of the heel section. All of the flanges are downwardly convergent and have a bottom edge. The bottom edge of the heel and toe section flanges extends downwardly from the sole a greater distance than does the bottom edge of the peripheral flange. Depending upon the playing surface on which the sole is to be used, additional ovoid-shaped toe section flanges can be positioned intermediate the first or inner toe section flange and the peripheral flange. Additional heel flanges positioned intermediate the first heel flange and the peripheral flange on the heel section of the sole can also be employed. The additional heel and toe section flanges are especially advantageous for use on synthetic playing surfaces.

34 Claims, 8 Drawing Figures

Fig. 1.
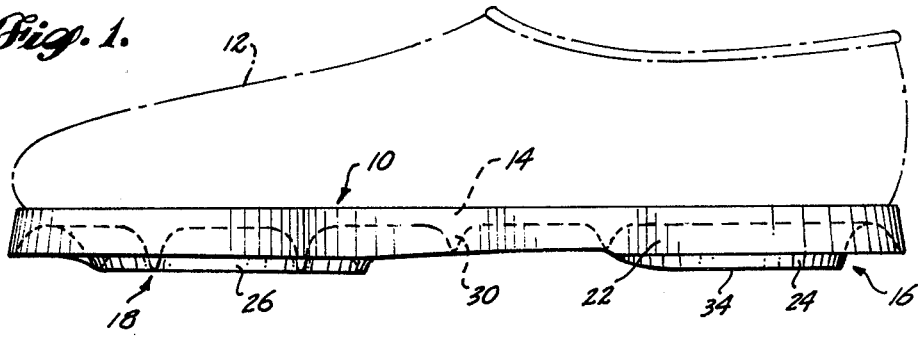
Fig. 2.
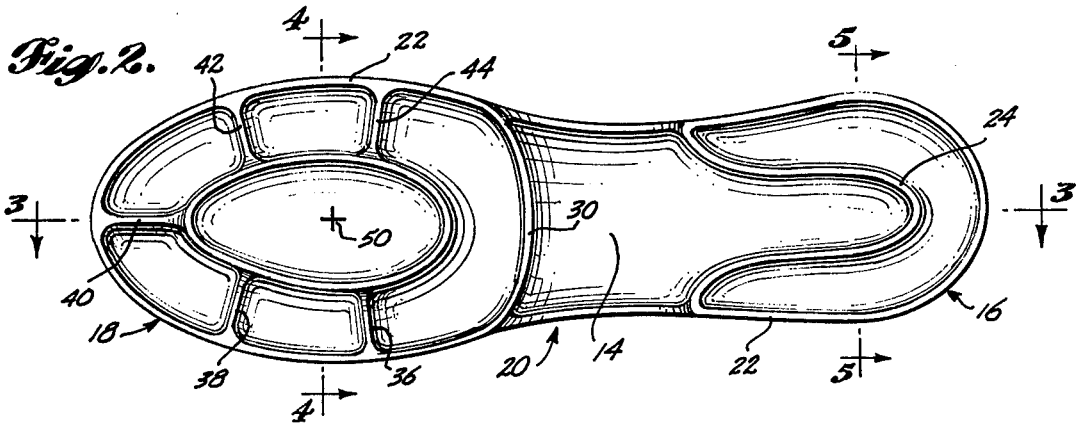
Fig. 3.
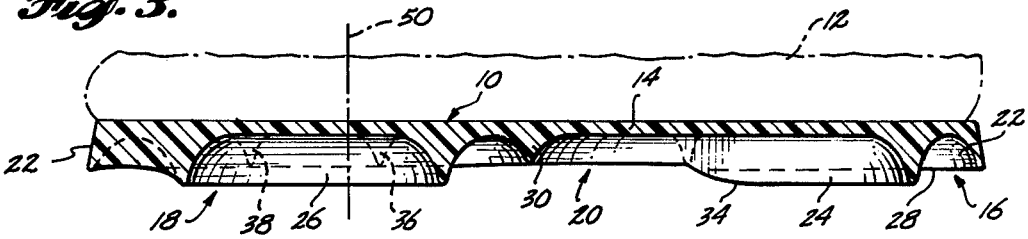
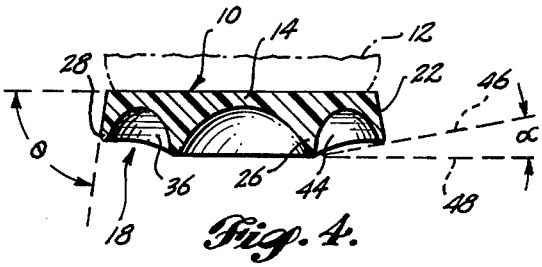
Fig. 4.
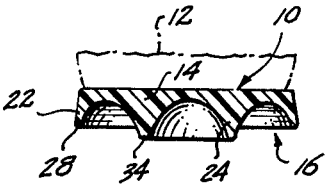
Fig. 5.

ATHLETIC SHOE SOLE

BACKGROUND OF THE INVENTION

The present invention relates to shoe soles and more particularly to novel gripping members on athletic shoe soles for use on natural and synthetic turf-type playing surfaces.

The advent of synthetic playing surfaces for soccer, football and other sports previously played solely on natural turf has brought about a concomitant increase in the injury to athletes, especially knee and ankle injuries. Knee and ankle injuries suffered on synthetic surfaces have been attributed primarily to the inadequate tractive and releasing capability of shoe soles employed by athletes. Attempts to adapt traction soles previously used on natural playing surfaces for use on synthetic playing surfaces have met with some success but in general have been unsatisfactory, as the number of injuries on synthetic surfaces attributable at least in part to inadequately designed traction soles has continued to grow with increased usage of synthetic playing surfaces.

Consequently, it is a broad object of the present invention to provide an improved traction-type athletic shoe sole for use on synthetic playing surfaces of the type intended to simulate natural turf surfaces and at the same time to provide an improved traction-type athletic shoe sole that is adaptable for use on natural playing surfaces. Another broad object of the present invention is to provide a traction-type athletic shoe sole that will substantially reduce the athlete injury rate, especially on synthetic playing surfaces, that has previously been attributed to inferior traction soles. Additional objects of the present invention are to provide a traction-type shoe sole for athletic shoes that will allow relatively free rotation of the shoe on a playing surface about an upright axis running through the ball of an athlete's foot while providing good traction on the surface for the athlete, thereby allowing torsional release of the shoe from the playing surface while maintaining sufficient traction to prevent an athlete from slipping or falling; to provide a traction-type shoe sole that will improve the turning and cutting ability of an athlete when running on a synthetic playing surface, that is, to provide a traction-type shoe sole that will maintain traction on the playing surface while allowing the athlete to quickly change his direction of movement and at the same time provide the athlete with necessary rotational freedom of his ankle and knee relative to the playing surface, thereby reducing the possibility of injury to the ankle or knee; to provide a traction-type shoe sole that will maintain a large proportional contact area with the playing surface even though the athlete's foot may be turned at an angle sidewardly relative to the plane of the playing surface, that is, to allow the athlete's ankle along its fore and aft horizontal axis of rotation to remain in its anatomical position, that is, its normal upright position, even though the athlete's leg and body may be angularly oriented relative to the playing surface; and to provide a traction-type shoe sole having traction members that are safer and more efficient for the wearer of the athletic shoe sole as well as being unlikely to cause severe injury to those colleagues or opponents on the playing field that might have the misfortune of coming into physical contact with the traction members.

SUMMARY OF THE INVENTION

In accordance with the foregoing objects and other objects that will become apparent to one of ordinary skill after reading the following specification, the present invention provides a shoe sole having a heel section and a toe section. The shoe sole has a downwardly extending flange that extends around the entire periphery of the shoe sole. Preferably, the flange is downwardly and outwardly extending and has downwardly convergent inner and outer surfaces. A toe section flange is positioned on the toe section of the sole and extends downwardly therefrom at a location spaced inwardly from the peripheral flange. Preferably, the toe section flange extends downwardly and outwardly and has downwardly convergent inner and outer surfaces. More preferably, the bottom edge of the toe section flange is ovoid in shape and extends below the upper surface of the shoe sole a distance slightly greater than the bottom edge of the peripheral flange. A heel section flange is positioned on the heel section of the shoe sole and extends downwardly therefrom. The heel section flange has an arcuate rearward portion spaced inwardly from the rear portion of the peripheral flange on the heel section and has two laterally spaced portions extending forwardly from each end of the arcuate portion. The laterally spaced sections are spaced from each other and also are spaced inwardly from the peripheral flange along the sides of the heel section. The heel section flange preferably extends downwardly and outwardly from the heel section and has downwardly convergent inner and outer surfaces. More preferably, the forward end of the spaced, forwardly extending portions of the heel flange diverge outwardly at the forward end of the heel section and join with the peripheral flange at that location on the sole. Depending upon the particular playing surface, i.e., whether synthetic or natural turf, additional heel section and toe section flanges can be added as necessary to provide additional traction. Preferably, the shoe sole is made of a resilient composition having sufficient stiffness so that it does not collapse under the weight of an athlete but having sufficient elasticity so that pressure or sliding contact with human skin will not easily lacerate the skin or bruise underlying musculature. Several commercially available synthetic elastomeric compositions are suitable for the shoe sole of the present invention.

BRIEF DESCRIPTION OF THE DRAWINGS

A better understanding of the present invention can be derived from reading the ensuing specification in conjunction with the accompanying drawings wherein:

FIG. 1 is a side elevation of the shoe sole of the present invention with a shoe upper shown in phantom outline;

FIG. 2 is a bottom view of the shoe sole of the present invention;

FIG. 3 is a longitudinal sectional view of the shoe sole taken along section line 3—3 of FIG. 2;

FIG. 4 is a cross-sectional view of the shoe sole taken along section line 4—4 of FIG. 2;

FIG. 5 is a cross-sectional view of the shoe sole taken along section 5—5 of FIG. 2;

DETAILED DESCRIPTION

Figure 6:
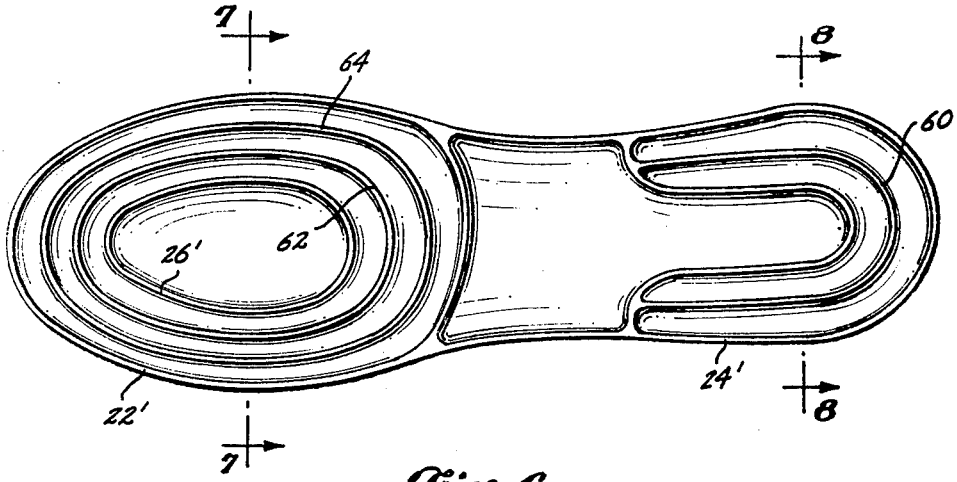
FIG. 6 is a bottom view of a second embodiment of the shoe sole of the present invention adapted for use on certain types of synthetic turf.
Figure 7:
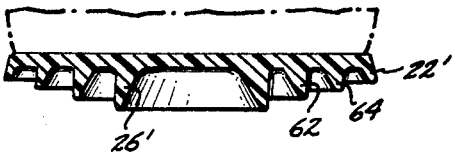
FIG. 7 is a cross-sectional view of the second embodiment taken along section line 7—7 of FIG. 6.
Figure 8:
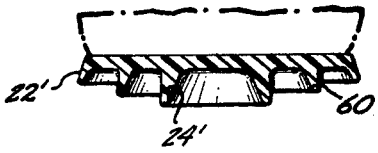
FIG. 8 is a cross-sectional view of the second embodiment taken along section line 8—8 of FIG. 6.

Referring first to FIG. 1, the athletic shoe sole 10 of the present invention is adapted for attachment to an athletic shoe 12 of generally conventional configuration, and can be adapted to any special purpose shoe as required. The particular athletic shoe depicted in FIGS. 1 through 5 can be used on both natural playing surfaces, such as sod, or on synthetic playing surfaces, such as one of the commercially available synthetic turf surfaces used to simulate natural sod. On the other hand, the embodiments depicted in FIGS. 6 through 8 are adapted for use on synthetic playing surfaces for reasons that will be enlarged upon below.

Referring conjunctively to FIGS. 1 through 5, the shoe sole has an upper, plate-like base portion 14 from which traction members on the heel section 16 and toe section 18 of the sole depend. The base portion 14 of the shoe sole has a generally planar upper surface and, in plan view, has a generally conventional outline, with a laterally enlarged toe section 18 having a rounded forward end and a laterally enlarged heel section 16 with a rounded rearward end. The arch portion 20 of the shoe sole intermediate the heel section and the toe section has a reduced width to accommodate the normal shaping of an athletic shoe upper. The shoe sole is adapted for attachment to a conventional insole or can be adapted for direct attachment to the shoe upper.

The traction members in this embodiment include a downwardly extending, outer peripheral flange 22, a downwardly extending heel section flange 24 and a downwardly extending toe section flange 26. The peripheral flange extends continuously around the entire periphery of the sole base portion 14 and generally extends not only downwardly but slightly outwardly relative to the vertical so that it defines a bottom edge 28 generally lying within a common plane. The depth of the peripheral flange 22 in the arch section of the sole is slightly reduced to accommodate better flexure of the shoe sole in the center section as the athlete walks or runs in the shoe. However, the portions of the peripheral flange bottom edge located in the toe section and in the heel section lie substantially in a common plane, that is, substantially parallel to the upper surface of the base portion 14. The peripheral flange 22 has an outside surface and an inside surface that are generally convergent in the downward direction that merge into each other to form the bottom edge 28 of the peripheral flange. In a preferred embodiment, the angle $\theta$ (depicted in FIG. 4) between the upper surface of the base portion 14 of the sole and the outside surface of the peripheral flange is less than 90°, preferably around 80°, although for certain applications it is preferred for the angle $\theta$ to be orthogonal to the upper planar surface of the base portion 14.

The toe section flange 26 extends downwardly from the central portion of the toe section 18 of the sole. The toe section flange 26 has two longitudinally extending sides that are spaced inwardly from the adjacent side portions of the peripheral flange 22 along the sides of the toe section. The sides of the toe section flange are joined by arcuate forward and rearward portions that merge into the side portions of the toe section flange to define an annular flange of generally ovoid shape. The forward portion of the toe section flange is spaced rearwardly from the forward portion of the peripheral flange while the rearward portion of the toe section flange lies adjacent the rearward portion of the toe section. Like the peripheral flange, the toe section flange 26 extends downwardly and outwardly along its side portions and extends downwardly and rearwardly along its forward and rearward arcuate portions. The inner and outer side surfaces of the toe section flange 26 are generally downwardly convergent and merge toward the bottom end of the toe section flange into and define the bottom edge 32 of the toe section flange. The toe section flange 26 defines a recess that is upwardly concave in both the longitudinal direction of the sole and in the lateral direction of the sole to form a surface similar to that of a portion of a prolate spheroid. The region between the peripheral flange and the toe section flange is generally concave in the upward direction when viewed in a direction transverse to the flanges. In this embodiment, the bottom edge of the toe section flange lies generally in a plane parallel to the upper surface of the base portion 14. In addition, the plane defined by the bottom edge of the toe section flange lies slightly below the plane defined by the bottom edge of the peripheral flange around the toe section. In other words, the bottom edge of the toe section flange is located at a depth relative to the upper surface of the base portion 14 slightly below the depth of the bottom edge of the peripheral flange 22.

An arcuate, reinforcing, transverse flange 30 is positioned on the toe section 18 rearwardly of the toe section flange 26 and extends between opposite portions of the peripheral flange 22 adjacent the rear of the toe section of the sole. The transverse flange 30 extends downwardly from the base portion 14 and has generally downwardly convergent fore and aft sides that merge to form a bottom edge lying generally in the same plane as that defined by the bottom edge of the peripheral flange 22. The outer ends of the reinforcing flange 30 curve forwardly from the central portion of the flange and merge into the peripheral flange adjacent the rearward end of the toe section 18.

The heel flange 24 has an arcuate rearward portion spaced inwardly at substantially equal distances from the rearward arcuate portion of the peripheral flange 22 on the heel section. The forward ends of the rearward arcuate portion curve forwardly and merge into two spaced, generally forwardly extending, longitudinal portions of the heel flange. Adjacent the forward end of the heel section, the forwardly extending portions of the heel flange flare or diverge outwardly and merge into the peripheral flange adjacent the forward end of the heel section 16. The heel flange extends generally downwardly from the base portion 14 and has downwardly convergent inner and outer surfaces that merge to form a bottom edge 34 lying in a plane generally parallel to and preferably coplanar with the plane defined by the bottom edge of the toe section flange 26. The outwardly flaring portions of the heel section flange 24 have a gradually reduced depth as they extend outwardly toward the peripheral flange so that, where the outwardly flaring portions merge into the peripheral flange, they have a depth equal to the depth of the peripheral flange. The heel section flange and the peripheral flange cooperate to form an upwardly concave recess therebetween when viewed transversely to the flanges.

Although not necessary, but preferred, reinforcing webs 36, 38, 40, 42 and 44 extend transversely between the inner surface of the peripheral flange 22 and the outer surface of the toe section flange 26 to rigidify the peripheral flange and the toe section flange. Two longitudinally spaced webs 36 and 38 are located on one side of the toe section flange 26, while a second pair of longitudinally spaced webs 42 and 44 are located on the opposite side of the toe section flange 26. The fifth web 40 runs in the longitudinal direction of the sole between the inside surface of the peripheral flange and the forward outside surface of the toe section flange adjacent the front of the toe section. All of the webs have downwardly convergent side surfaces that merge to form a bottom edge. The bottom edge of each of the webs has a depth adjacent the peripheral flange equal to the depth of the peripheral flange and gradually increases in depth as it extends inwardly toward the toe section flange 26 so that, when it joins the toe section, the depth of the flange is equal to that of the toe section flange.

The toe section and heel section flanges have a greater depth than the peripheral flange to provide better angular stability to an athlete's ankle when he is turning a corner at speed. Specifically, the peripheral, toe and heel section flanges are designed so that the athlete's ankle will remain at its nominal or anatomical position as he turns a corner at speed, even though his legs and body are oriented at an angle to the playing surface. The angle between a line 46 drawn between the bottom edges of the peripheral flange and, for example, the toe section flange at right angles to the longitudinal direction of the sole and a line 48 parallel to the upper surface of the base portion 14 of the sole is preferably between 12° and 15°. This is an average angle at which an athlete's leg will be oriented relative to a playing surface when he is turning a sharp corner at speed, that is, when he is cutting into the turf to change his direction quickly. The reduced depth of the peripheral flange allows both the peripheral flange and the toe and heel section flanges to sink into and grip the playing surface, whether it be natural or synthetic, when the shoe sole itself is at an angle of on the order of 12° to 15° to the turf. Thus, the depth difference between peripheral and toe section flanges allows the shoe sole to provide the same traction as would be provided if the shoe sole were parallel to the turf and at the same time eliminates lateral strain on the athlete's ankle. Moreover, the generally rounded or ovoid shape of the toe section flange 26 as well as the arcuate transverse flange 30 at the rearward end of the toe section allows the sole to relatively freely rotate about a vertical axis (generally designated 50 in FIGS. 3 and 4), thus relieving any torsional stresses that would otherwise be transmitted to the knee or ankle of an athlete when turning a short corner or pivoting on the ball of his foot. Thus the shoe sole of the present invention helps to eliminate two of the major causes of injury to athletes when playing on natural or synthetic turf. First, the shoe sole eliminates the lack of angular stability provided by conventional shoes when an athlete, turning or cutting quickly in turf, has only one edge of his conventional shoe sole contacting the turf and has the rest of his shoe sole, including gripping members on the shoe sole, raised away from the turf so that they do not secure an adequate bite. In addition, the arcuate shape of the toe section flange as well as the forward end of the peripheral flange and the transverse flange allow relatively free rotation of the shoe in the turf, thus relieving torsional stresses that could otherwise cause severe injury to the ankle or knee of an athlete.

Referring now to FIGS. 6, 7 and 8, an alternate embodiment of the invention adapted especially for use on synthetic playing surfaces is illustrated. This embodiment of the invention again employs an outer peripheral flange 22', an inner heel section flange 24' and an inner toe section flange 26'. The three basic flanges are generally of similar construction to that of the previous embodiment. In this embodiment, an additional intermediate heel flange 60 is interposed between the peripheral flange 22' and the inner heel flange 24'. The intermediate heel flange 60 extends downwardly and slightly outwardly. The sides of the intermediate heel flange are downwardly convergent and merge to define a bottom edge that terminates in a plane lying generally between the planes defined by the bottom edge of the peripheral flange 22' and the bottom edge of the inner heel flange 24'. Also, rather than forming an upwardly concave, smooth, interconnecting surface between the flanges, the bottom surface of the base member 14' is generally planar and the side surfaces of the peripheral inner and intermediate heel flanges intersect the base member 14' at a sharp angle with the intersecting portions of the flanges and the base member being filleted.

In a similar manner, the second embodiment of the invention includes two intermediate toe section flanges 62 and 64 spaced from each other and positioned between the peripheral flange 22' and the inner toe section flange 26'. Again, the side surfaces of the intermediate flanges 62 and 64 are downwardly convergent and merge into bottom edges that define planes lying intermediate the inner toe section flange 26' and the peripheral flange 22' so that a transverse line drawn between the inner toe section flange 26' and the peripheral flange 22' would be coincident with the bottom edges of all four flanges. The additional heel and toe flanges of the second embodiment of the invention are necessitated for use on some synthetic turfs where synthetic fibers or cords extending up from the base mat of the material are spread further apart than might normally be encountered on a thickly piled synthetic turf or on natural turf. Thus the additional flanges provide additional tractive ability for the shoe sole by gripping more of the vertical cords on the synthetic surface than in the previous embodiment, while still retaining all of the advantages of the first embodiment.

The shoe soles of the present invention can be manufactured, as mentioned above, from a variety of synthetic materials. A preferred material from which a shoe sole for use on natural turf can be manufactured is an elastomeric polyvinylchloride having a Shore Durometer hardness of approximately 55. For a shoe sole adapted for use on a synthetic turf and hard, icy fields, a silicated plastisol can be used. Such a plastisol consists of sharp silica aggregate added to a base material such as the polyvinylchloride suggested above.

After reading the foregoing specification, one of ordinary skill in the art will be able to effect various changes, substitutions of equivalents and other alterations without departing from the general concepts disclosed. For example, the number and size of additional heel and toe section flanges can be varied for the particular turf on which the shoe is to be used. Only two combinations have been shown in the foregoing drawings; however, many other combinations are possible. In addition, the bottom edges of the flanges in both embodiments can be serrated or scalloped. However, under some circumstances such a modification would not be desired as the torsional release capability of the toe section of the shoe would be somewhat inhibited by an irregular bottom edge on the flanges. It is therefore intended that the grant of Letters Patent hereon be limited only by the definition contained in the appended claims and equivalents thereof.

What is claimed is:

1. A shoe sole having a heel section and a toe section comprising:

a peripheral flange running substantially continuously around the periphery of said heel section and said toe section, said peripheral flange being integral with said heel section and said toe section and extending downwardly and outwardly therefrom, said peripheral flange terminating in a substantially continuous bottom edge lying in a first plane, and a downwardly extending toe section flange positioned in the toe section of said shoe sole, said toe section flange having an arcuate forward portion spaced inwardly from the forward portion of the peripheral flange on the toe section, having laterally spaced, rearwardly extending side portions spaced inwardly from said peripheral flange and joined to the arcuate portion of said toe section flange, and having an arcuate rearward portion joined to the side portions of said toe section flange to form an annularly shaped toe section flange, said toe section flange terminating in a substantially continuous bottom edge lying substantially in a second plane parallel to said first plane, said second plane lying below said first plane, and a downwardly extending heel section flange positioned in the heel section of said shoe sole, said heel section flange having an arcuate rearward portion spaced inwardly from the rearward portion of said peripheral flange on said heel section and having spaced, forwardly extending portions joined with said arcuate portion.

2. The shoe sole of claim 1 wherein said heel section flange terminates in a bottom edge lying substantially in a third plane substantially parallel to said first plane.

3. The shoe sole of claim 2 wherein said second and thrid planes are coplanar.

4. The shoe sole of claim 2 wherein the spaced, forwardly extending portions of said heel section flange flare outwardly adjacent the forward end of said heel section and join said peripheral flange.

5. The shoe sole of claim 1 wherein said shoe sole has an upper, substantially planar face adapted for attachment to a shoe upper, said upper planar face lying substantially in a fourth plane, said peripheral flange extending outwardly and downwardly at an angle of between about 5° and about 15° relative to a line orthogonal to said fourth plane.

6. The shoe sole of claim 1 wherein said peripheral flange has inner and outer surfaces, said inner and outer surfaces being downwardly convergent.

7. The shoe sole of claim 1 wherein the bottom edge of said peripheral flange defines a first plane and wherein the bottom edge of said toe section flange defines a second plane, the angle formed between the second plane and a line drawn between the bottom edge of the peripheral flange and the bottom edge of the toe section flange and oriented orthogonally to the direction of the longitudinal dimension of said shoe sole being in the range of from about 12° to about 15°.

8. The shoe sole of claim 1 wherein said toe section flange has downwardly convergent inner and outer surfaces.

9. The shoe sole of claim 8 wherein the bottom edge of said heel section flange is located below the bottom edge of said peripheral flange.

10. The shoe sole of claim 9 wherein the bottom edge of said peripheral flange defines a first plane and the bottom edge of said heel section flange defines a second plane, the angle formed between said second plane and a line drawn between the bottom edge of said peripheral flange and the bottom edge of said heel section flange and oriented orthogonally to the direction of the longitudinal dimension of said shoe sole being in the range of from about 12° to about 15°.

11. The shoe sole of claim 1 further comprising a rearwardly concave, arcuate flange positioned along the rearward portion of said toe section and extending generally transversely between opposite sides of said peripheral flange, said rearwardly concave flange being spaced rearwardly from said toe section flange.

12. The shoe sole of claim 11 wherein said rearwardly concave flange merges into the peripheral flange portions on each side of said toe section.

13. The shoe sole of claim 12 wherein said rearwardly concave, arcuate flange has downwardly convergent forward and aft surfaces.

14. The shoe sole of claim 1 further comprising: an interconnecting web flange extending between said toe section flange and said peripheral flange, said interconnecting web flange extending transversely relative to said peripheral and toe section flanges.

15. The shoe sole of claim 14 comprising a plurality of said interconnecting web flanges spaced from each other, each of said web flanges having bottom edges interconnecting the bottom edges of the peripheral and toe section flanges.

16. The shoe sole of claim 1 further comprising: a first intermediate, annularly shaped flange positioned in the toe section of said shoe sole, said intermediate flange extending downwardly from said shoe sole and being located between said toe section flange and said peripheral flange.

17. The shoe sole of claim 16 wherein said toe section flange and said first intermediate flange extend downwardly and outwardly from said toe section.

18. The shoe sole of claim 17 wherein said peripheral and toe section flanges have bottom edges and wherein said intermediate flange has a bottom edge located below the upper surface of said shoe sole intermediate the locations of the bottom edges of said peripheral flange and said toe section flange relative to the upper surface of said shoe sole.

19. The shoe sole of claim 16 further comprising: a second intermediate flange extending downwardly from said shoe sole and being positioned between said first intermediate flange and said peripheral flange.

20. The shoe sole of claim 19 wherein said second intermediate flange extends downwardly and outwardly from said shoe sole.

21. The shoe sole of claim 20 wherein said peripheral, toe section, first intermediate, and second intermediate flanges have respective bottom edges, the bottom edge of said first intermediate flange extending downwardly to a depth intermediate the depth of the bottom edges said peripheral flange and said toe section flange, the bottom edge of said second intermediate flange extending downwardly to a depth intermediate the depth the bottom edges of said first intermediate flange and said peripheral flange.

22. The shoe sole of claim 16 further comprising an intermediate heel flange extending downwardly from the heel section of said shoe sole and being positioned intermediate the location of said heel section flange and said peripheral flange on the heel section of said shoe sole.

23. The shoe sole of claim 22 wherein said intermediate heel flange has an arcuate rearward portion spaced from the rearward portion of the peripheral flange on the heel section of said shoe sole and having forwardly extending flange portions spaced from each other and joined to opposite ends of the arcuate portion of said intermediate heel flanges, said forwardly extending flange portions of said intermediate heel flange joining with the forward portions of said heel section flange.

24. The shoe sole of claim 22 wherein said intermediate heel flange extends downwardly and outwardly from the heel section of said shoe sole.

25. The shoe sole of claim 24 wherein said peripheral flange, said heel section flange and said intermediate heel flange have respective bottom edges, the bottom edge of said heel section flange being located below the bottom edge of the portion of the peripheral flange on the heel section of said shoe sole, the bottom edge of the intermediate heel flange being located at a depth intermediate the location of the bottom edges of said peripheral flange and said heel section flange.

26. The shoe sole of claim 16 wherein said toe section flange and said intermediate flange have respective bottom edges, each having an ovoid shape.

27. The shoe sole of claim 1 wherein said toe section flange has a bottom edge having an ovoid shape.

28. The shoe sole of claim 27 wherein the inside surface of the toe section flange defines a concave recess in a direction transverse to the longitudinal dimension of the shoe sole.

29. The shoe sole of claim 27 wherein the inner surface of said peripheral flange and the outer surface of said toe section flange define an upwardly concave recess on said toe section in the direction transverse to said flanges.

30. A shoe sole having a heel section and a toe section comprising:

a peripheral flange running substantially continuously around the periphery of said toe section, said peripheral flange being integral with said toe section and extending downwardly and outwardly therefrom, said peripheral flange terminating in a substantially continuous bottom edge lying in a first plane, said bottom edge being annularly shaped, and a downwardly extending toe section flange positioned in the toe section of said shoe sole, said toe section flange having an arcuate forward portion spaced inwardly from the forward portion of the peripheral flange on the toe section and having laterally spaced, rearwardly extending side portions spaced inwardly from said peripheral flange and joined to the arcuate portion of said toe section flange, said toe section flange terminating in a substantially continuous bottom edge lying substantially in a second plane substantially parallel to said first plane, said second plane lying below said first plane, said toe section flange having an arcuate rearward portion joined to the side portions thereof to form an annularly shaped toe section flange, all portions of the bottom edge of said toe section flange being substantially equidistantly spaced inwardly from the corresponding portions of said peripheral flange.

31. The shoe sole of claim 30 wherein said shoe sole has an upper, substantially planar face adapted for attachment to a shoe upper, and wherein said peripheral flange has inner and outer surfaces that are downwardly convergent, the outer surface of said peripheral flange extending downwardly and outwardly at an angle of about 5° to about 15° relative to a line orthogonal to said planar face.

32. The shoe sole of claim 31 further comprising a first intermediate, annularly shaped flange positioned in the toe section of said shoe sole, said intermediate flange extending downwardly from said shoe sole and being located between said toe section flange and said peripheral flange.

33. The shoe sole of claim 30 wherein said sole is comprised of a silicated plastisol.

34. The shoe sole of claim 1 wherein said sole is comprised of a silicated plastisol.

* * * * *